US006889781B2

(12) United States Patent
Mazorow

(10) Patent No.: US 6,889,781 B2
(45) Date of Patent: May 10, 2005

(54) HORIZONTAL DIRECTIONAL DRILLING IN WELLS

(75) Inventor: Henry B. Mazorow, Lorain, OH (US)

(73) Assignee: Performance Research & Drilling, LLC, Lorain, OH (US)

( * ) Notice: Subject to any disclaimer, the term of this patent is extended or adjusted under 35 U.S.C. 154(b) by 0 days.

(21) Appl. No.: 10/189,652

(22) Filed: Jul. 3, 2002

(65) Prior Publication Data

US 2002/0175004 A1 Nov. 28, 2002

Related U.S. Application Data

(63) Continuation of application No. 09/788,210, filed on Feb. 16, 2001, now Pat. No. 6,578,636.

(60) Provisional application No. 60/182,932, filed on Feb. 16, 2000, and provisional application No. 60/199,212, filed on Apr. 24, 2000.

(51) Int. Cl.[7] ..... E21B 15/04

(52) U.S. Cl. ..... 175/77; 175/78; 175/80; 175/81; 166/55

(58) Field of Search ..... 175/77, 78, 79–82, 175/61, 62; 166/298, 55, 55.1

(56) References Cited

U.S. PATENT DOCUMENTS

| | | | |
|---|---|---|---|
| 1,367,042 | A | 2/1921 | Ganville |
| 1,485,615 | A | 3/1924 | Jones |
| 1,733,311 | A | 10/1929 | McNeill |
| 1,804,819 | A | 5/1931 | Spencer, Jr. et al. |
| 1,904,819 | A | 3/1933 | Blodgett |
| 2,065,436 | A | 12/1936 | Ervin |
| 2,117,277 | A | 5/1938 | Dyer |
| 2,181,512 | A | 11/1939 | Kirby |
| 2,181,980 | A | 12/1939 | Seale |
| 2,213,498 | A | 9/1940 | Kinzbach |
| 2,251,916 | A | 8/1941 | Cross |
| 2,271,005 | A | 1/1942 | Grebe |
| 2,360,425 | A | 10/1944 | Kinzbach |

(Continued)

FOREIGN PATENT DOCUMENTS

| | | |
|---|---|---|
| JP | 1134037 | 5/1989 |
| JP | 5331903 | 12/1993 |

OTHER PUBLICATIONS

"Hole Saw Kits & Accessories", including products from The L.S. Starrett Company, product catalog, p. 24, dated before Feb. 28, 2000.

The L.S. Starrett Company, "Saw Blades", Starrett webpage (2 pages) for Catalog No. KV1090 for "Automotive Hole Saw Kit", 2001.

Bozidar Omrcen et al., "Application and Results of Petro Jet®Multilateral Drilling in Croatia", PJMLS: Oct. 2001, Int.'l Conf. pp. 1–22.

*Primary Examiner*—Hoang Dang
(74) *Attorney, Agent, or Firm*—Pearne & Gordon LLP

(57) ABSTRACT

A method and apparatus for horizontally drilling in wells utilizing a shoe assembly at the down hole end of upset tubing. The shoe assembly includes a fixed section and a rotatable section suspended below the fixed section. An electric motor and associated batteries and a gyroscope carried on the rotatable section enable an operator on the surface to selectively rotate and position the rotatable section to any desired angular location for drilling a hole in the well casing. After one or more holes have been cut in the casing, a drill assembly can be removed from the upset tubing and be replaced by a high pressure blaster nozzle to bore into the formation zones. The gyroscope enables the operator to accurately position the rotatable section to the same locations at which the holes have been cut. The drill assembly includes an electric motor with an associated battery, flexible drive shaft, and a hole saw.

21 Claims, 5 Drawing Sheets

U.S. PATENT DOCUMENTS 2,500,785 A * 3/1950 Arutunoff ..... 175/78
2,516,421 A * 7/1950 Robertson ..... 175/78
2,521,976 A 9/1950 Hays
2,539,047 A * 1/1951 Arutunoff ..... 175/40
2,633,682 A 4/1953 Jackson
3,191,697 A 6/1965 Haines
3,224,506 A 12/1965 Huitt et al.
3,262,508 A 7/1966 Price
3,670,831 A 6/1972 Winter, Jr. et al.
3,797,576 A * 3/1974 Azalbert et al. ..... 166/299
3,838,736 A 10/1974 Driver
3,840,079 A 10/1974 Williamson
3,853,185 A 12/1974 Dahl et al.
3,873,156 A 3/1975 Jacoby
3,958,649 A 5/1976 Bull et al.
4,007,797 A 2/1977 Jeter
4,168,752 A 9/1979 Sabol
4,185,705 A * 1/1980 Bullard ..... 175/78
4,354,558 A 10/1982 Jageler et al.
4,365,676 A 12/1982 Boyadjieff et al.
4,368,786 A 1/1983 Cousins
4,431,069 A 2/1984 Dickinson, III et al.
4,445,574 A 5/1984 Vann
4,474,252 A 10/1984 Thompson
4,526,242 A 7/1985 Mathieii et al.
4,533,182 A 8/1985 Richards
4,589,499 A 5/1986 Behrens
4,601,353 A 7/1986 Schuh et al.
4,640,353 A 2/1987 Schuh
4,640,362 A 2/1987 Schellstede
4,646,831 A 3/1987 Marsh et al.
4,658,916 A 4/1987 Bond
4,763,734 A 8/1988 Dickinson et al.
4,786,874 A 11/1988 Grosso et al.
4,790,384 A 12/1988 Schellstede et al.
4,832,143 A 5/1989 Kaalstad et al.
4,832,552 A 5/1989 Skelly
4,836,611 A 6/1989 El-Saie
4,842,487 A 6/1989 Buckman et al.
4,848,486 A 7/1989 Bodine
4,854,400 A 8/1989 Simpson
4,890,681 A 1/1990 Skelly
4,947,944 A 8/1990 Coltman et al.
5,006,046 A 4/1991 Buckman et al.
5,012,877 A 5/1991 Winters et al.
RE33,660 E 8/1991 Jelsma
5,090,496 A 2/1992 Walker
5,113,953 A 5/1992 Noble
5,148,877 A 9/1992 MacGregor
5,148,880 A 9/1992 Lee et al.
5,161,617 A 11/1992 Marschke
5,165,491 A 11/1992 Wilson
5,183,111 A 2/1993 Schellstede
5,194,859 A 3/1993 Warren
5,210,533 A 5/1993 Summers et al.
5,259,466 A 11/1993 Venditto et al.
5,318,121 A 6/1994 Brockman et al.
5,330,016 A 7/1994 Paske et al.
5,392,856 A * 2/1995 Broussard et al. ..... 166/285
5,394,951 A 3/1995 Pringle et al.
5,396,966 A 3/1995 Roos, Jr. et al.
5,410,303 A 4/1995 Comeau et al.
5,413,184 A 5/1995 Landers
5,439,066 A 8/1995 Gipson
5,458,209 A 10/1995 Hayes et al.
5,528,566 A 6/1996 McGee et al.
5,553,680 A 9/1996 Hathaway
RE35,386 E 12/1996 Wu et al.
5,687,806 A 11/1997 Sallwasser et al.
5,699,866 A * 12/1997 Cousins et al. ..... 175/78
5,853,056 A 12/1998 Landers
5,892,460 A 4/1999 Jerabek et al.
5,899,958 A 5/1999 Dowell et al.
5,934,390 A 8/1999 Uthe
5,944,123 A 8/1999 Johnson
5,987,385 A 11/1999 Varsamis et al.
6,003,599 A 12/1999 Huber et al.
6,012,526 A * 1/2000 Jennings et al. ..... 166/298
6,125,949 A 10/2000 Landers
6,155,343 A 12/2000 Nazzal et al.
6,173,773 B1 1/2001 Almaguer et al.
6,189,629 B1 2/2001 McLeod et al.
6,260,623 B1 7/2001 Schick
6,263,984 B1 7/2001 Buckman, Sr.
6,283,230 B1 9/2001 Peters
6,352,109 B1 3/2002 Buckman, Sr.
6,378,629 B1 4/2002 Baird
6,412,578 B1 7/2002 Baird
6,668,948 B2 12/2003 Buckman, Sr. et al.
2002/0070013 A1 * 6/2002 Bond ..... 166/50

* cited by examiner

HORIZONTAL DIRECTIONAL DRILLING IN WELLS

This application is a continuation of U.S. patent application Ser. No. 09/788,210, filed Feb. 16, 2001 now U.S. Pat. No. 6,578,686 which claims the priority of U.S. Provisional Patent Application No. 60/182,932 filed Feb. 16, 2000, and U.S. Provisional Patent Application No. 60/199,212 filed April 24, 2000.

BACKGROUND OF INVENTION

The invention relates to not only new wells, but also to revitalizing preexisting vertical and horizontal oil and gas vertical wells that have been depleted or are no longer profitable, by improving the porosities of the wells' payzone formations. This is accomplished by providing a micro channel through the already existing casing, and out into the formation.

PRIOR ART

After a well has been drilled, completed, and brought on-line for production, it may produce oil and gas for an unknown period of time. It will continue to produce hydrocarbons, until the production drops below a limit that proves to be no longer profitable to continue producing, or it may stop producing altogether. When this happens, the well is either abandoned or stimulated in a proven and acceptable process. Two of these processes are called Acidizing and Fracturizing. Acidizing uses an acid to eat away a channel in the formation thus allowing the hydrocarbons an easier access back to the well bore. Fracturizing uses hydraulic pressure to actually crack and split the formation along preexisting cracks in the formation. Both of these methods increase the formation's porosity by producing channels into the formation allowing the hydrocarbons to flow easier towards the annulus of the well which increases the production of the well along with it's value. However, the success of these operations is highly speculative. In some wells, it may increase the production rate of a well many times over that of it's previous record, but in others, they may kill the well forever. In the latter case the well must be plugged and abandoned. Both Acidizing and Fracturizing are very expensive. Both require dedicated heavy mobile equipment, such as pump trucks, water trucks, holding tanks, cranes along with a large crew of specialized personnel to operate the equipment.

A more efficient method of stimulating a vertical well is to drill a hole in the well casing, and then bore a micro-horizontal channel into the payzone using a high pressure water jet to produce a channel for the hydrocarbons to follow back to the well bore's annulus. Once an initial lateral hole through the already existing casing, has been produced. The micro drill must be brought back to the surface. Then a high pressure water jet nozzle is lowered into the well and through the above-mentioned hole in the casing and out into the payzone. It then produces a finite lengthened channel out radially away from the well bore into the payzone. Once this is completed, it to must be brought back to the surface.

Because of the limitations of the present technology, the entire drill string is then manually rotated from the surface to blindly rotate the drill shoe (located at the bottom of the drill string) for the next drilling and boring operation. The process is repeated until the desired number of holes/bores has been reached.

It is very difficult and imperfect to rotate an entire drill string, so that the exit hole of the shoe, which is located at the bottom of the drill string, is pointing exactly in the desired direction. For example, if the well casing is tilted or off-line, the drill string may bind so that the top portion rotates while the bottom portion (including the shoe) may not actually move or move less than the rotation at the surface. This is due to the fact that all of the applied torque does not reach completely to the bottom of the drill string due to friction encountered up hole from the shoe.

SUMMARY OF THE INVENTION

The invention provides a method and apparatus that allows the for the drilling and completion of a plurality of lateral holes in the well casing in one step, removal of the drill, then lowering of the blasting nozzle and re-entering each of the holes in succession to horizontally bore into the formation without interruptions or without having to turn the entire drill string at the surface to realign with each hole.

In accordance with the invention, the shoe assembly consists of a fixed section and a rotating working section. The fixed section is threaded into the down hole end of upset tubing, such as straight tubing or coiled tubing or any other method known in the art, to lower the entire shoe assembly to a desired depth. The fixed section provides a central channel or passage to allow a drill apparatus (with a flexible drill shaft and a special cutting tool) to be inserted into the assembly.

The rotatable working section is attached to the fixed section by a specially designed guide housing and ring gear that facilitates the turning of the turns the rotating section within the well casing. The ring gear converts the rotation of a motor driven transfer bar or drive shaft, turned by a self contained bi-directional variable speed DC motor, into rotation of this section. The DC motor is controlled by an operator at the surface and is powered by a self-contained lithium battery. The rotating section has a rotating vertical bore that passes through the center of the ring gear and into an elbow-shaped channel that changes the direction of the of the flexible shaft and cutter from a vertical entry into a horizontal exit to allow the drilling of holes in the well casing.

A gyroscope in the rotatable section communicates the precise angular position of the rotatable section to the operator on the surface via a multiconductor cable or by wireless transmission to allow the operator to align the rotating section to the desired position to cut the hole. The operator can then reorient the rotatable section of the shoe assembly for sequential drilling operations, if desired. When the drill is retracted and the water jet nozzle is then lowered back through the shoe, the operator again reorients the shoe assembly.

The drill apparatus, comprised of a housing, a shaft and a bit, may be of any type desired that will fit inside the upset tubing and through the shoe. The bit preferably is a hole cutter comprised of a hollow cylindrical body with a solid base at one end and a series of cutters or teeth at the other end. The terminal end of the body is serrated or otherwise provided with a cutting edge or edges. As the serrated edge of the cutter contacts the inside of the well casing, it begins to form a circular groove into the casing. As pressure is applied, the groove deepens until a disc (coupon) is cut out of the casing.

Sensors can be installed in the shoe assembly so that lights or alarming devices, on the operator's console located at the surface can indicate a variety of information:

a. The drill has entered the shoe and is seated correctly.
b. The bit has cut through the casing and the hole is completed.

A core can be substituted for the hole cutter that would allow for the side of the casing and part of the formation to be cored. The cores could be brought to the surface to show the condition of the casing and the thickness of the cement. A mill can be substituted for the cutter to allow the casing to be cut in two if the casing was damaged. The use of a cutter and motor can be replaced with a series or battery of small shaped charges to produce the holes in the side of the casing. If the well bore is filled with liquid, the shoe can be modified to accept a commercial sonar device. This creates a system that can be rotated a full 360 degrees to reflect interior defects or imperfections. If the well bore is devoid of liquids, the shoe can be modified to accept a sealed video camera. This creates a system to provide a 360 degree view of all interior defects and imperfections.

DESCRIPTION OF PREFERRED EMBODIMENT

Figure 1:
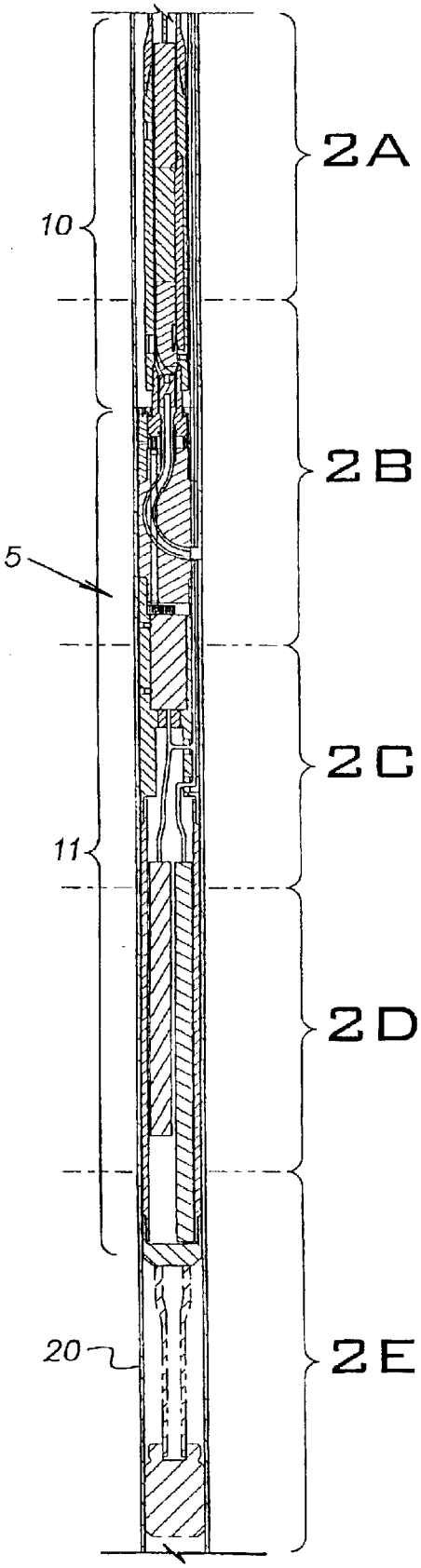
FIG. 1 is a vertical cross-sectional view of apparatus constructed in accordance with the invention and positioned in a deep well casing.
Figure 2A:
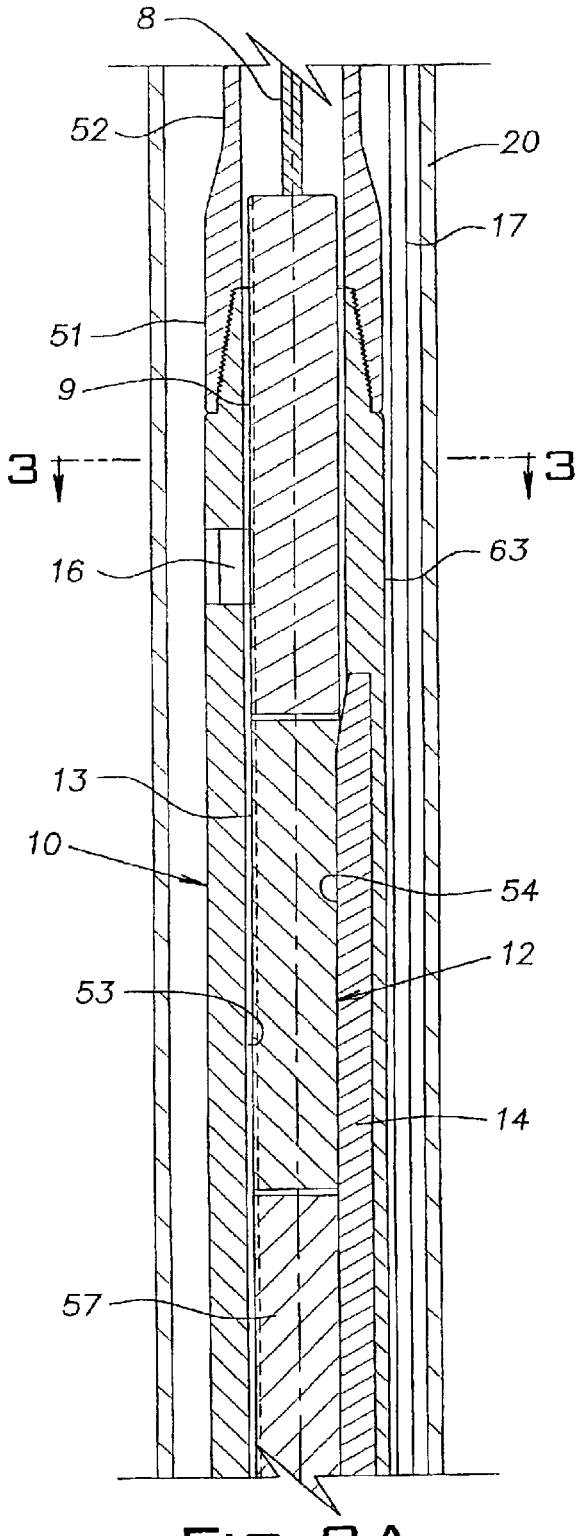
FIGS. 2A through 2E are cross-sectional views of the apparatus on a somewhat enlarged scale corresponding to the bracketed areas shown in FIG. 1.
Figure 2B:
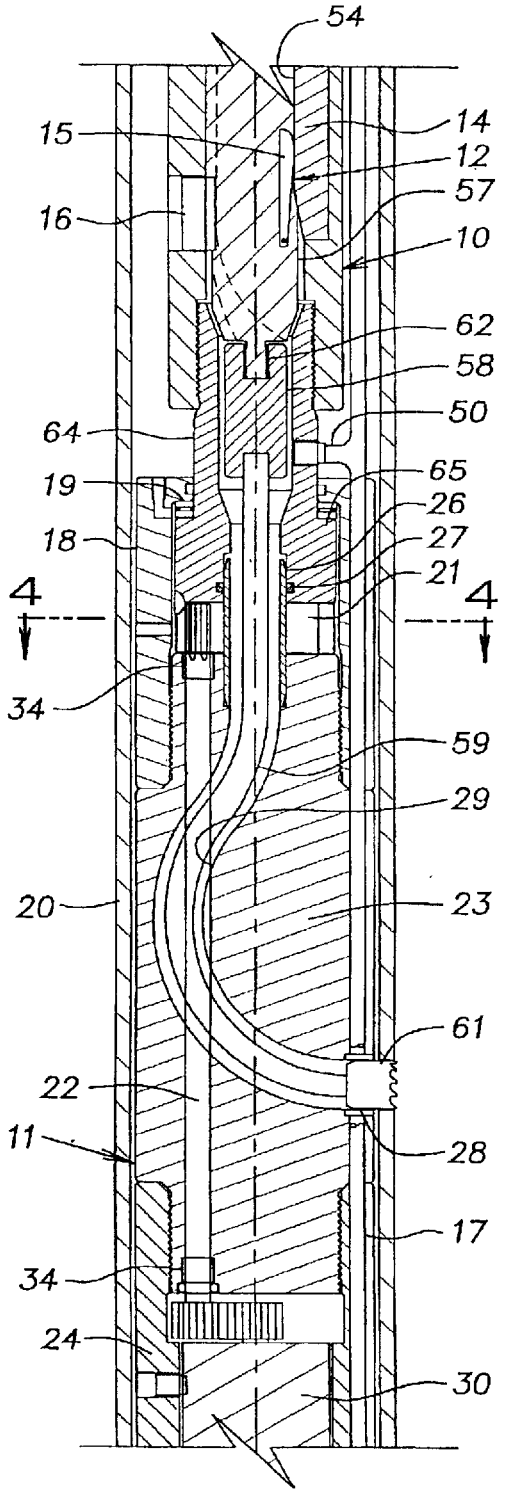
Figure 2C:
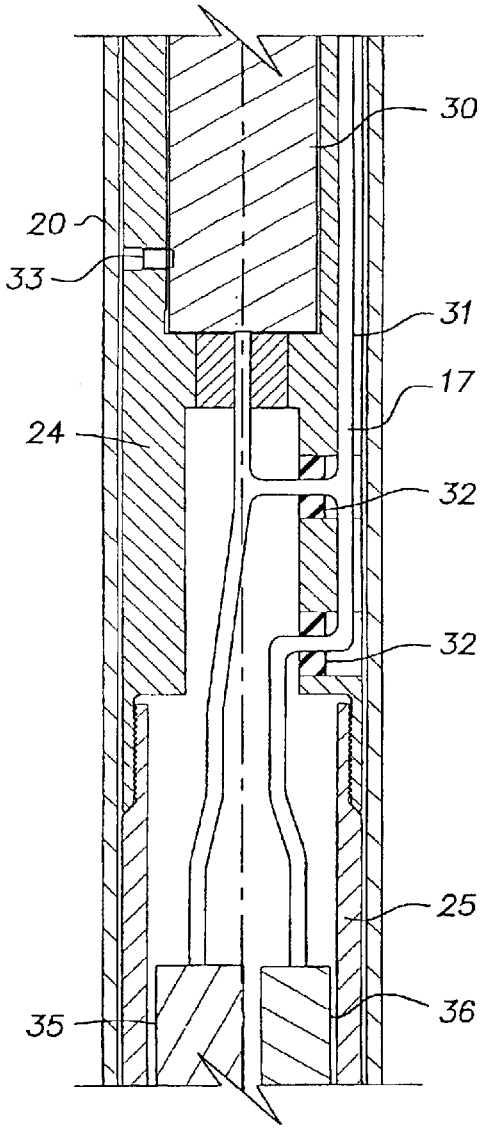
Figure 2D:
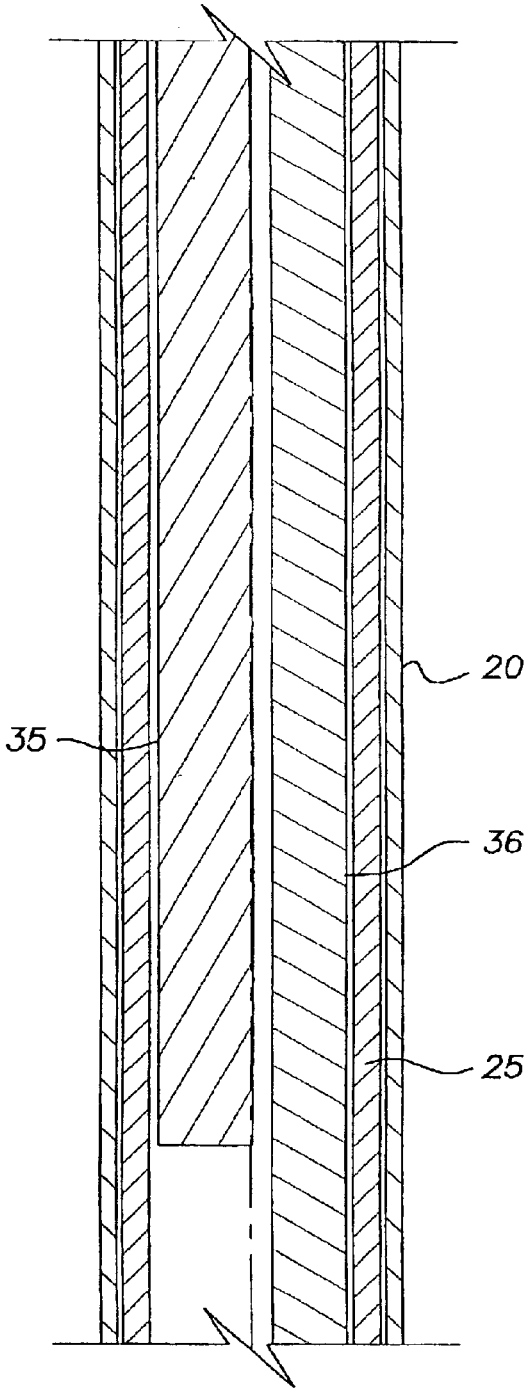
Figure 2E:
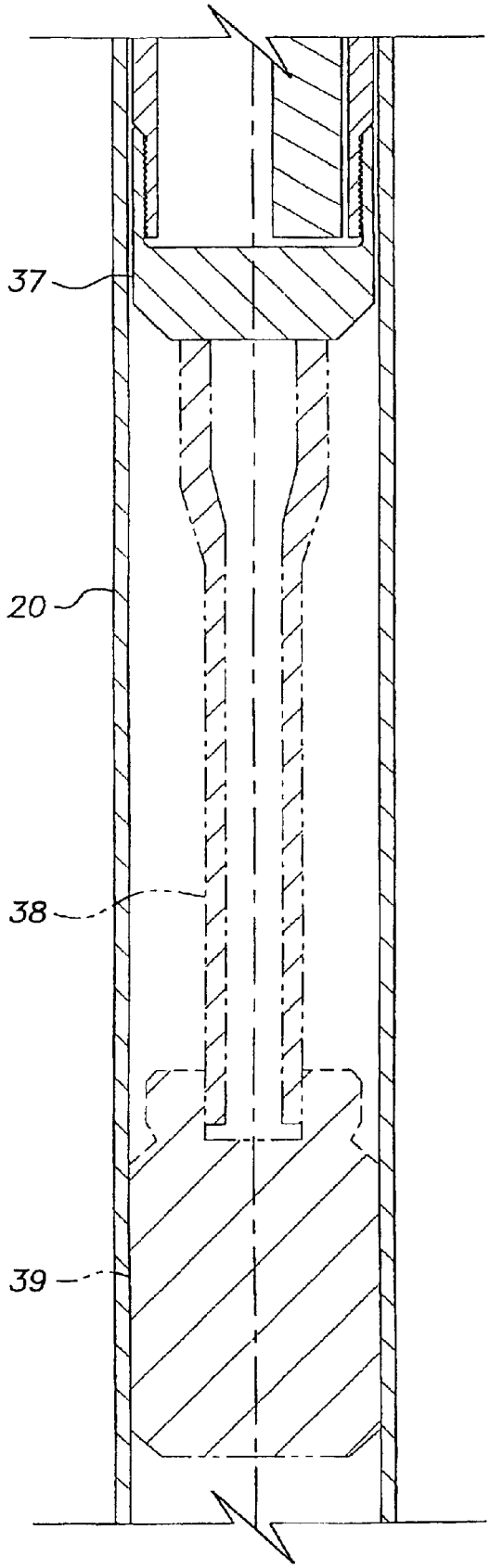

The entire contents of U.S. Provisional Patent Application No. 60/182,932, filed Feb. 16, 2000 and U.S. Provisional Patent Application No. 60/199,212, filed Apr. 24, 2000 are incorporated herein by reference.

FIG. 1 and FIGS. 2A through 2E schematically illustrate components of a cylindrical shoe assembly 5 capable of horizontally drilling into vertical well casings 20 and boring into hydrocarbon payzones in oil and gas wells. It will be understood that the invention has other applications from the following description, such as employing a coring bit that would core into the side of the well casing 20 and part of the surrounding formation to determine the casing condition and the composition of the surrounding formation, using a milling tool to cut the well casing 20 in two, employing a series or battery of small shaped charges to produce holes in the side of the casing 20 or to use a video camera or sonar device to locate and determine interior defects and imperfections in the well casing 20.

The cylindrical shoe assembly 5 is composed of a fixed section 10, below which a rotatable working section 11 is attached.

The fixed section 10 is threaded into the down hole end 51 of upset tubing 52, or straight tubing or coiled tubing. The upset tubing 52 enables the shoe assembly 5 to be lowered to a desired depth within the well casing 20. The fixed section 10 has a central channel or passage 53 to allow for the insertion and retraction of a drill apparatus 12 that is comprised of sinker bars 9 of a selected total weight to insure sufficient pressure for cutting, a battery 13, a drill motor 57, chuck 58, a flexible drill shaft 59, and a cutter 61. The sinker bars 9, battery 13 and drill motor 57 are threaded into each other and the total apparatus 12 is vertically supported from the surface for raising and lowering by a high strength stranded wire cable 8 as known in the art. The down hole housing of the drill motor has a self aligning surface, such as used on a universal down hole orientation sub known in the art, to self align the drill apparatus 12 with anti spin lugs 16 fixed into the inner wall of the channel 53 to prevent the apparatus 12 from rotating. The chuck 58 is threaded onto a shaft 62 of the drill motor 57. The flexible drill shaft 59 is silver soldered or otherwise fixed to the base of the chuck 58.

Figure 3:
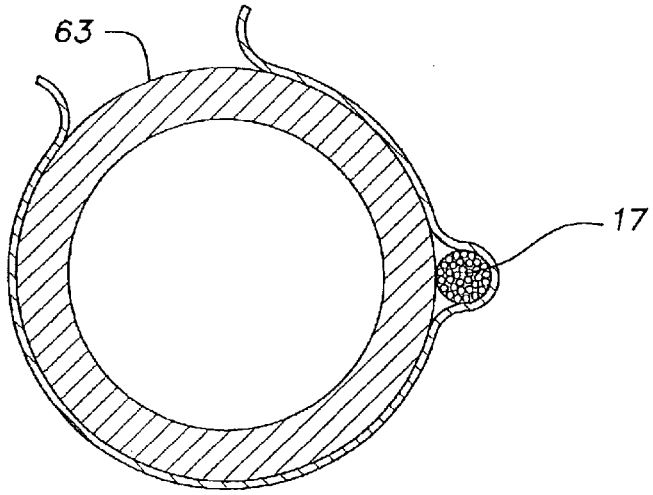
FIG. 3 is a transverse cross-sectional view of the apparatus taken in the plane 3—3 indicated in FIG. 2A.

It is desirable to be able to vary the speed of the drill shaft 59. If the hole cutter 61 initially contacts the well casing while operating at full speed, it is possible that the cutter might catch on an imperfection in the casing, causing the drill to torque and even break. Thus, it is advantageous to have the drill operating at a low speed initially, then increase its speed once the drilling process begins. To this end, and referring to FIG. 2B, a ramp 14 with a cam surface 54 is welded into a slot in the channel 53 of the fixed section wall on which a mechanical switch 15 rides to turn the drill motor 57 on. (Other types of switches known in the art can be used). The switch 15 is deflected or depressed by contact with the cam surface 54 of ramp 14 as the motor 57 is lowered. The switch 15 engages or rides along the ramp 14 and is gradually deflected or depressed as the motor 57 is lowered, to vary the speed of the drill (hole cutter 61). The switch 15 can also consist of a wet connect type connection and the power may be supplied by an external battery pack. Alternatively, sensors can be placed at locations on the drill housing or motor and/or along the adjacent wall or the wall adjacent the shaft 59 or hole cutter 61 to identify the position, location and/or orientation of the drill or motor 57 or hole cutter 61 in relationship to the shoe assembly 5. With respect to electric motors, the drill may be activated and/or controlled through use of such sensors when the drill reaches certain preselected locations adjacent the wall so that, for example, the drill starts and stops as described above when it reaches certain positions (such as the cutter 61 is about to contact the casing, or the cutter 61 has just gone through the casing) and a sensor is activated. A mud motor, however, is powered by the flow of fluid from a pump and is controlled almost exclusively by the volume of fluid flowing through it. Therefore, sensors in or near the shoe assembly 5 can detect the presence of the mud motor in or near the shoe and how far in the shoe it is, but the fluid flow dictates the speed of the mud motor and thus the speed of the flexible drill shaft 59 powered by the mud motor. In another embodiment, a proximity sensor 50 in a inner guide housing 64 senses the presence of the chuck 58; a signal from the sensor is transmitted in a multi-conductor cable. The multi-conductor cable 17 conducts signals for controlling the rotation of the working section 11 and indicating its angular position to the operator on the surface via gyro 36. This cable is banded to the exterior of the wall 52 of the drill string from the shoe to the surface. This is to keep it from snagging on the inside of the well casing 20 and becoming damaged while tripping in or out of the hole, as shown in FIG. 3.

The motor 57 to power the flexible drill shaft 59 and hole cutter 61 (as described in the preceding paragraph) can be any motor that is known in the art. Preferably, the motor 57 is a mud motor. More preferably, the motor 57 is an electric motor, most preferably a lithium battery-powered electric motor. Most preferably, the motor 57 is a battery powered electric motor (preferably lithium battery) that is controlled from the surface via a wireline. Less preferably, the battery powered electric motor can be suspended by cable into the well casing 20, and be controlled via a series or combination of micro switches, trigger switches, sensors and ramps, for example as described above. In this embodiment, the switches and sensors can be disposed, for example, in the drill housing and/or motor and/or wall casing 20 etc. whereby the sensors indicate when the hole cutter 61 has entered the shoe assembly 5, and/or when the hole cutter 61 has contacted or penetrated the casing 20. The motor 57 is activated by entering the shoe assembly 5 or otherwise based upon its position in or near the shoe, casing, etc. Still less preferably, the motor 57 can be an electric motor that is both powered and controlled via powerline from the surface.

The fixed inner guide housing 64 threaded into the down hole end of the fixed section 10 provides a shoulder 65 onto which a cylindrical end cap 18, into which the rotating section 11 is threaded, sits supported by oil filled thrust bearings 19 that allow the rotating section 11 to turn within the well casing 20.

Figure 4:
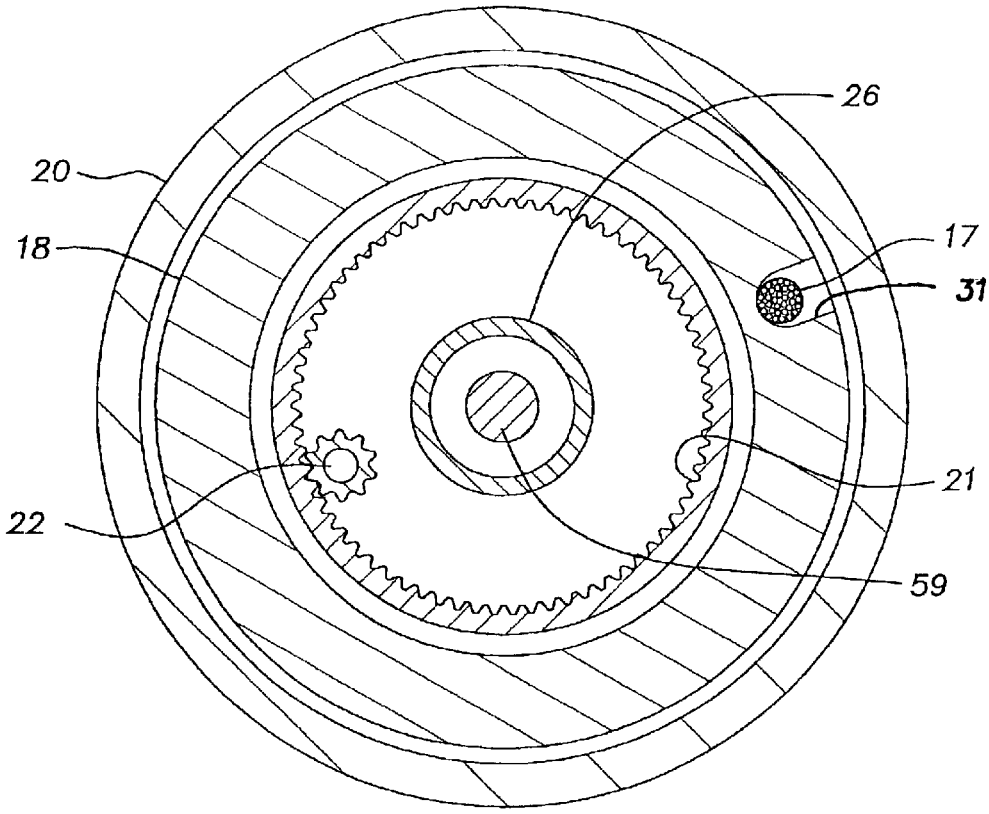
FIG. 4 is a transverse cross-sectional view of the apparatus taken in the plane 4—4 indicated in FIG. 2B.

The rotating section 11 comprises a cylindrical cutter support body 23, a cylindrical motor housing 24, a cylindrical battery/gyroscope housing 25, and a metal shoe guide 37. A ring gear 21, detailed in FIG. 4, is welded to or otherwise fixed to the base of the inner guide housing 64 to convert the turning of a transfer bar or drive shaft 22 into rotation of this section 11 in respect to the upper fixed section 10. The inner guide housing 64 also provides an annular clearance to allow free rotation of the flexible drill shaft chuck 58 that is threaded onto the drill motor shaft 62.

A rotating vertical sleeve 26 sealed by an o-ring 27 is recessed in a counter bore in the inner guide housing 64. The sleeve 26 passes through the center of the ring gear 21 and is pressed or otherwise fixed into the cylindrical cutter support body 23. The body, 23 is threaded into or otherwise fixed to the cylindrical end cap 18. At it's lower end, the body 23 is threaded into the cylindrical motor housing 24. The rotating sleeve 26 guides the hole cutter 61 and the flexible drill shaft 59 into an elbow-shaped channel 29, of circular cross-section, formed in the cylindrical cutter support body 23, that changes the direction from a vertical entry into a horizontal exit. A hardened bushing 28, in the cutter support body 23 works as a bearing to support the hole cutter 61 for rotation and guides the hole cutter 61 in a radial direction.

Figure 5:
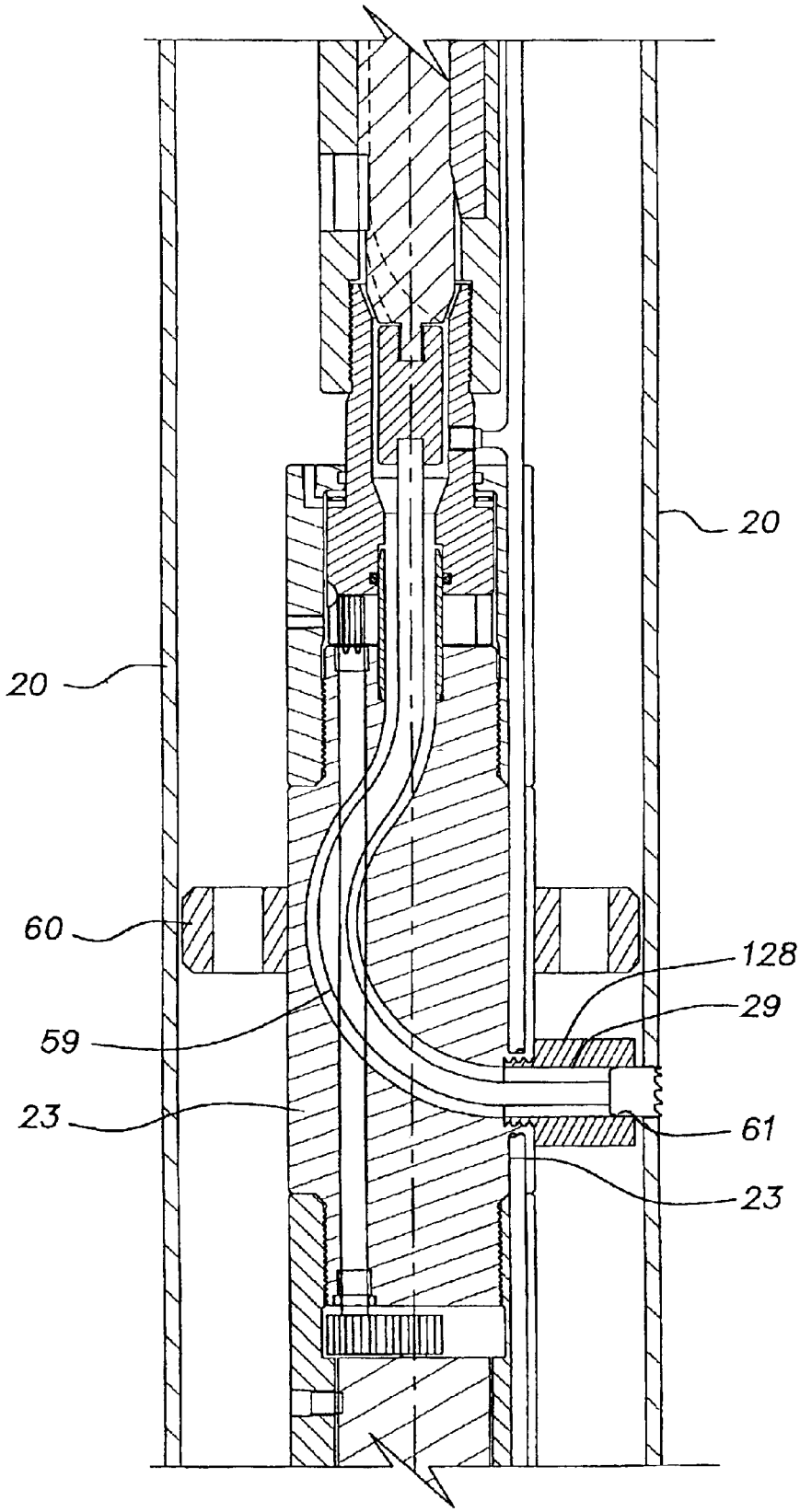
FIG. 5 is a vertical cross-sectional view of a modified form of certain parts of the apparatus.

Various sized centralizing rings 60 and modified bushings 128, shown in FIG. 5, may be used so that the same shoe assembly 5 can be used in casings of different inside diameters. These centralizing rings 60 are screwed, welded, bolted or otherwise fixed at selected locations on the outside of the shoe assembly 5. The centralizing ring 60 should be notched, channeled or shaped like a star so only a few points touch the casing, to allow for the free flow of fluid, gas and fines past the shoe and up and down the inside of the well casing. This design also aids in the insertion and withdrawal of the shoe from the casing acting as a centralizing guide within the casing walls 20. Alternatively, the bushing 128 can be integral with a centralizing ring.

While the preferred hole cutter 61 is a hole saw, other cutters such as a milling cutter or other cutters known in the art may be used. The preferred cutter 61 comprises a hollow cylindrical body with a solid base at it's proximal end and cutting teeth or abrading elements known in the art, at the terminal end. A magnet may be located inside the hollow body and attached to the base to retain one or more coupons removed from the casing 20 when a hole has been completed. Alternatively, the coupon or disc may be left in the formation and subsequently pushed out of the path of the boring nozzle by the high pressure water.

It has been found that surprisingly good results have been achieved in this application by using a standard hole saw as compared to conventional milling cutters. It is believed that this excellent performance comes from the ability of the hole saw to cut a relatively large hole while only removing a proportionally small amount of material.

The multi-conductor cable 17 extends down through a slot 31 milled into the walls of the rotating section 11. The multi-conductor cable 11 leads to and is connected through grommets 32 to a bi-directional, variable speed DC motor 30 in the motor housing 24. The DC motor 30, which is controlled by an operator on the surface through the multi-conductor cable 17, and vertically stabilized by security plugs 33 to keep the motor from spinning within the motor housing 24. This DC motor rotates the vertical transfer bar or drive shaft 22 extending upward, through a radial roller bearing 34 at each end of the shaft to aid in support and rotation, to the ring gear 21, to turn the rotating section 11.

The multi-conductor cable 17 continues down through the milled slot 31 in the cylindrical battery/gyroscope compartment 25 to both the battery pack 35 and a gyroscope 36 which are secured within the compartment 25. The DC battery pack 35 preferably comprises lithium batteries or other power supplies known in the art. The lithium batteries 35 provide power to the DC motor 30 and to the gyroscope 36.

The gyroscope 36 may be an inertial or rate type gyroscope or any other type of gyroscope known in the art. The gyroscope 36, fixed relative to the rotating section 11 and specifically aligned to the exit hole of the cutter support body 23, communicates the precise direction in degrees of the position of the rotating section to the operator on the surface via the multiconductor cable 17. Alternatively, this data can be relayed by wireless transmissions to allow the operator to operate the motor 30 in order to turn the rotating section 11 to the desired position to cut a hole in the well casing 20, or to a previously cut hole allowing the high pressure water hose and jet blasting nozzle to begin the boring process (not shown). In the absence of the preferable gyroscope 36, other methods, known in the art, for indicating the angular position of the rotating section 11 can be used. This will provide a starting point and will be used to position the rotating section 11 for initial and sequential hole cutting and boring.

A beveled cylindrical metal shoe guide 37 caps the bottom of the rotating section 11 for ease in lowering the entire shoe assembly 5 through the well casing 20 to the desired depth.

A tail pipe 38, shown in phantom, may carry a gamma ray sensor or other type of logging tool known in the art, and can be used to determine the location of a hydrocarbon payzone or multiple payzones. This logging tool may be screwed into or otherwise attached to the shoe guide 37. A packer 39, shown in phantom, may be attached to the tailpipe 38. The packer 39 as known in the art, preferably made of inflatable rubber, is configured in such a way that when it is expanded there are one or more channels, notches or passageways to allow the free flow of fluid, gas and fines up and down the casing 20. When expanded, the packer 39 stabilizes the position of the shoe assembly 5 restricting its ability to move up or down the well bore thus reducing a potential problem of being unable to reenter holes in the side of the casing.

In operation, when the well casing 20 is clear of all pumping, data collecting or other working or instrumentation fixtures, the entire shoe assembly 5 is threaded into the down-hole end of the upset tubing 52 or any other means by which to transport the entire assembly 5 to the desired depth within the well casing 20.

The technicians on the surface employ the high strength wire cable 8 to lower the drilling apparatus 12 down the inside of the upset tubing 52 into the fixed section of the shoe assembly 10. The design of the drill motor housing will ensure that the drill apparatus 12 will properly align itself and seat into the anti-spin lugs 16 in the fixed section central channel 53. Sensors can be installed into the shoe assembly so that lights or other methods of indication on or at the control console, usually inside a truck, could provide a variety of information to the operator.

Once the shoe assembly 5 is at the desired depth, the operator then rotates the lower portion of the shoe by activating a rheostat or other controlling device located at the surface, and monitors a readout as to the shoe's direction via the signals provided by the multi-conductor 17. This engages the battery 35, bi-directional motor 30, and gyroscope 36 assembly by which the operator can manipulate the direction of the shoe to the desired direction or heading based on customer needs.

Technicians on the surface lower the drilling apparatus 5 so that the mechanical power on switch 15 turns on the drill motor 57 at the proper rate, turning the flexible drill shaft 59 and cutter 61. As the serrated edge of the cutter 61 contacts the wall of the well casing 20, it begins to form a groove in the casing 20. The selected mass of weight of the sinker bars 9 provide the appropriate thrust to the cutter. The groove deepens until a disc or coupon is cut out of the casing wall. The proximity sensor 50 senses the presence of the chuck 58 in the annular clearance in the inner guide housing 64, and indicates to the operator that the hole has been completed.

Once the operator has cut the initial hole he pulls the drilling apparatus up the hole approximately 20 feet to ensure that the flexible cable is not obstructing the shoes ability to be turned to the next direction, he again uses the data provided from gyroscope 36 in the battery/gyroscope compartment 25 and sends a signal to the bi-directional, variable speed DC motor 30 to turn the rotating section 11 a specified number of degrees to cut the next hole. This process continues at that same desired depth until all the desired holes are cut in the well casing 20. Preferably, several sequential holes are cut at the same depth before bringing the drill apparatus 12 to the surface.

Once the desired number of holes are cut in the well casing 20 at the desired depth and the drilling apparatus has been removed, the process of boring into the hydrocarbon payzones at that same depth may begin.

The technicians on the surface connect a high pressure jet nozzle known in the art (not shown), to the discharge end of a high pressure hose (not shown), which is connected to a flexible coil tubing, and begin to lower the nozzle down the upset tubing 52 and into the shoe assembly 5. Once the nozzle is seated in the elbow-shaped channel 29 in the cutter support body 23, the suction connection of the hose is connected to the discharge connection of a very high pressure pump (not shown). The very high pressure pump will be of a quality and performance acceptable in the art. The pump is then connected to an acceptable water source; usually a mobile water truck (not shown).

The technicians then advise the operator at the control console that they are ready to begin the boring process. The operator, using the information provided from the gyroscope 36, ensures that the cutter support body 23 is aligned with the desired hole in the well casing and advises the technicians to begin the boring process.

The technicians turn on the pump, open the pump suction valve and the high pressure water in the hose forces the nozzle through the elbow-shaped channel 29 and the hole in the casing and into the hydrocarbon payzone (not shown). The design of the jet nozzle housing, as known it the art, provides for both a penetrating stream of high pressure water to penetrate into the zone, and small propelling water jet nozzles located peripherally on the back of the nozzle to propel the nozzle into the zone. The technicians on the surface monitor the length of hose moving into the upset tubing 52 and turn the water off and retract the nozzle back into the elbow-shaped channel 29 when the desired length of penetration has been achieved.

With information provided by the gyroscope 36, the operator, at the control console, now rotates the shoe assembly to the next hole in line and the boring process can be repeated again. Once the boring process has been completed at a specific depth and the boring nozzle retrieved to the surface, the upset tubing 52 and shoe assembly 5 may be completely removed from the well casing, or alternatively raised or lowered to another depth to begin the process once again.

It is contemplated that the invention can be practiced with an assembly like that described above, but without a bi-directional variable speed DC motor 30, drive shaft 22, ring gear 21 and related components that enable the rotating section 11 to rotate in respect to the fixed section 10. In that case the shoe assembly 5 would comprise only fixed sub-assemblies. In such a case the entire assembly would be rotated by physically turning the upset tubing 52 from the surface. The data provided from the gyroscope 36 would be used to similarly locate the hole cutting locations and boring positions as described. While an electric motor is preferred for operating the cutter 61, a mud motor, known in the art, can alternatively be used. The mud motor is driven by fluid pumped through coil tubing connected to it from the surface.

Apart from the specific disclosures made here, data and information from the proximity sensor 50, gyroscope 36, gamma ray sensor, sonar or other sensors that may be used, may be transmitted to the operator on the surface by optical fiber, electrical conduit, sound or pressure waves as known in the art. Similarly, both the drill motor 57 and the bi-directional, variable speed DC motor 30 can be driven directly from the surface through appropriate power cables.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What it claimed is:

1. Apparatus for horizontally drilling in a well comprising a variable speed electric drill motor, a shoe assembly adapted to be lowered into a casing of a well, and a flexible drill shaft, said flexible drill shaft being connected to said variable speed electric drill motor for rotation thereof, said shoe assembly being adapted to removably receive said flexible drill shaft therein, said flexible drill shaft being with drawable from said shoe assembly while said shoe assembly remains lowered in said well casing.

2. Apparatus according to claim 1, said drill motor being a battery-powered electric motor.

3. Apparatus according to claim 2, further comprising a battery pack, said electric motor being powered by said battery pack.

4. Apparatus according to claim 3, said battery pack being a lithium battery pack.

5. Apparatus according to claim 1, further comprising a cutter attached to said flexible drill shaft, said cutter being effective to cut a hole in said well casing.

6. Apparatus according to claim 1, further comprising a plurality of sensors placed at locations on said drill motor and/or adjacent a path of said drill motor, said flexible shaft or a cutter attached to said flexible shaft, said sensors being effective to identify a position, location, and/or orientation of said drill motor or said cutter.

7. Apparatus according to claim 6, wherein said shoe assembly is adapted to redirect said cutter along a horizontal direction at a depth at which a hole or holes are to be drilled in said well casing, wherein said position, location, and/or orientation of said drill motor or said cutter are identified with respect to said shoe assembly.

8. Apparatus according to claim 5, said drill motor being controlled via sensors that indicate when said cutter reaches certain preselected locations.

9. Apparatus according to claim 8, wherein one of said preselected locations is just before said cutter contacts said well casing.

10. Apparatus according to claim 8, wherein one of said preselected locations is just after said cutter has gone through said well casing.

11. Apparatus according to claim 5, wherein said cutter is a hole cutter, said flexible drill shaft being arranged to rotate said cutter against said well casing to cut a hole therethrough.

12. Apparatus according to claim 11, said electric motor being a lithium battery-powered electric motor.

13. Apparatus according to claim 1, wherein said shoe assembly is adapted to be lowered into said well casino to a depth at which a hole or holes are to be drilled in a wall of said casing, said shoe assembly being adapted to receive a cutter, attached to said flexible drill shaft, in a vertically oriented path and to redirect said cutter along a radially oriented path to cut a hole in said well casing.

14. Apparatus according to claim 13, wherein when said drill motor, said flexible drill shaft and said cutter are withdrawn from said vertically and radially oriented paths, said vertically and radially oriented paths are adapted to receive a blasting nozzle and to direct said blasting nozzle into said hole in the well casing formed by said cutter.

15. Apparatus according to claim 13, said drill motor having a sensor to indicate when said cutter or said drill motor has entered said shoe assembly, and/or when said cutter has contacted or penetrated said casing.

16. Apparatus according to claim 1, said drill motor being controlled by a wireline.

17. Apparatus according to claim 1, said drill motor being suspended by a cable in said well, said motor being controlled by a series or combination of micro switches, trigger switches, sensors and/or ramps, wherein the sensors indicate when said cutter has entered a shoe assembly, and/or when a cutter attached to said flexible drill shaft has contacted or penetrated said well casing.

18. Apparatus for horizontally drilling in a well comprising an electric drill motor and a flexible drill shaft, said flexible drill shaft being connected to said electric drill motor for rotation thereof, said apparatus further comprising a channel disposed in said well and a ramp having a cam surface within said channel, said channel adapted to receive said drill motor therein, said drill motor having a switch, wherein said switch is depressed by contact with said cam surface of said ramp as said drill motor is lowered in said well.

19. Apparatus according to claim 18, said motor being actuated by operation of said switch in contact with said ramp.

20. Apparatus according to claim 18, said motor being a variable speed motor, wherein said switch is gradually depressed by contact with said ramp as said drill motor is lowered into said well, said gradual depression of said switch being effective to vary the speed of said drill motor, and thereby to vary a drilling speed of a cutter attached to said flexible drill shaft.

21. Apparatus for horizontally drilling in a well comprising an electric drill motor and a flexible drill shaft, said flexible drill shaft being connected to said electric drill motor for rotation thereof, said drill motor having a switch for actuation of said drill motor, said switch having a wet connect type of connection.

* * * * *

UNITED STATES PATENT AND TRADEMARK OFFICE

CERTIFICATE OF CORRECTION

PATENT NO. : 6,889,781 B2
DATED : May 10, 2005
INVENTOR(S) : Henry B. Mazorow et al.

It is certified that error appears in the above-identified patent and that said Letters Patent is hereby corrected as shown below:

Column 8,
Line 55, delete “with”.
Line 56, delete “drawable” and insert therefor -- withdrawable --.

Signed and Sealed this

Eighth Day of November, 2005

JON W. DUDAS
*Director of the United States Patent and Trademark Office*

UNITED STATES PATENT AND TRADEMARK OFFICE

CERTIFICATE OF CORRECTION

PATENT NO. : 6,889,781 B2
APPLICATION NO. : 10/189652
DATED : May 10, 2005
INVENTOR(S) : Henry B. Mazorow et al.

It is certified that error appears in the above-identified patent and that said Letters Patent is hereby corrected as shown below:

On the face of the Patent, under Inventors (75), please insert - - Paris E. Blair, Lorain, OH (US) - -.
On the face of the patent, under Inventors (75), please insert - - Chris Sanfelice, Kearns, UT (US) - -.
Claim 1, line 55, delete “with”.
Claim 1, line 56, delete “drawable” and insert therefor - - withdrawable - -.

Signed and Sealed this

Eighth Day of August, 2006

JON W. DUDAS
*Director of the United States Patent and Trademark Office*